US005301376A

United States Patent [19]

Herbert

[11] Patent Number: 5,301,376

[45] Date of Patent: Apr. 12, 1994

[54] PORTABLE SINK APPARATUS

[76] Inventor: Norbert G. Herbert, 10329 N. Forest Ave., Kansas City, Mo. 64155

[21] Appl. No.: 31,278

[22] Filed: Mar. 15, 1993

[51] Int. Cl.[5] ..... A47K 1/02

[52] U.S. Cl. ..... 4/626; 4/625; 220/379

[58] Field of Search ..... 4/514, 516, 518, 553, 4/554, 599, 602, 619, 625, 626, 627, 639, 640, 641, 642, 650, 653, 419, 620; 220/379, 744; 206/45.2, 45.28, 577

[56] References Cited

U.S. PATENT DOCUMENTS 944,586 12/1909 Wheeler ..... 4/626
2,594,938 4/1952 Leavitt ..... 4/626
3,045,252 7/1962 Sorrells ..... 4/626
3,081,395 3/1963 Wickenberg ..... 220/379 X
4,747,169 5/1988 Valbuena ..... 4/625

*Primary Examiner*—Robert M. Fetsuga
*Attorney, Agent, or Firm*—Leon Gilden

[57] ABSTRACT

A portable sink arranged for ease of transport and storage includes a central housing having respective lower and upper housings positioned on opposed sides of the central housing, wherein the upper housing includes a fluid reservoir structure arranged for orthogonal orientation relative to the central housing, with a faucet member permitting fluid flow therethrough upon pivoting of the faucet relative to a floor cavity within the upper housing floor. The lower housing includes an upper housing reservoir in communication with a sink within the central housing for storage and subsequent disposal of fluid within the lower housing.

7 Claims, 4 Drawing Sheets

PORTABLE SINK APPARATUS

BACKGROUND OF THE INVENTION

1. Field of the Invention

The field of invention relates to portable sink structure, and more particularly pertains to a new and improved portable sink apparatus wherein the same is arranged for compact storage and transport during periods of non-use.

2. Description of the Prior Art

Portable sink structure of various types are available in the prior art and exemplified by the U.S. Pat. Nos. 4,766,621 and 4,747,169.

The instant invention attempts to overcome deficiencies of the prior art by providing for a modular sink construction permitting the individual components of the sink apparatus for separable assemblage relative to a central housing and in this respect, the present invention substantially fulfills this need.

SUMMARY OF THE INVENTION

In view of the foregoing disadvantages inherent in the known types of portable sink apparatus now present in the prior art, the present invention provides a portable sink apparatus wherein the same includes modular components arranged for assemblage and disassemblage relative to one another for use as a sink organization. As such, the general purpose of the present invention, which will be described subsequently in greater detail, is to provide a new and improved portable sink apparatus which has all the advantages of the prior art portable sink apparatus and none of the disadvantages.

To attain this, the present invention provides a portable sink arranged for ease of transport and storage including a central housing having respective lower and upper housings positioned on opposed sides of the central housing, wherein the upper housing includes a fluid reservoir structure arranged for orthogonal orientation relative to the central housing, with a faucet member permitting fluid flow therethrough upon pivoting of the faucet relative to a floor cavity within the upper housing floor. The lower housing includes an upper housing reservoir in communication with a sink within the central housing for storage and subsequent disposal of fluid within the lower housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable sink apparatus which has all the advantages of the prior art portable sink apparatus and none of the disadvantages.

It is another object of the present invention to provide a new and improved portable sink apparatus which may be easily and efficiently manufactured and marketed.

It is a further object of the present invention to provide a new and improved portable sink apparatus which is of a durable and reliable construction.

An even further object of the present invention is to provide a new and improved portable sink apparatus which is susceptible of a low cost of manufacture with regard to both materials and labor, and which accordingly is then susceptible of low prices of sale to the consuming public, thereby making such portable sink apparatus economically available to the buying public.

Still yet another object of the present invention is to provide a new and improved portable sink apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
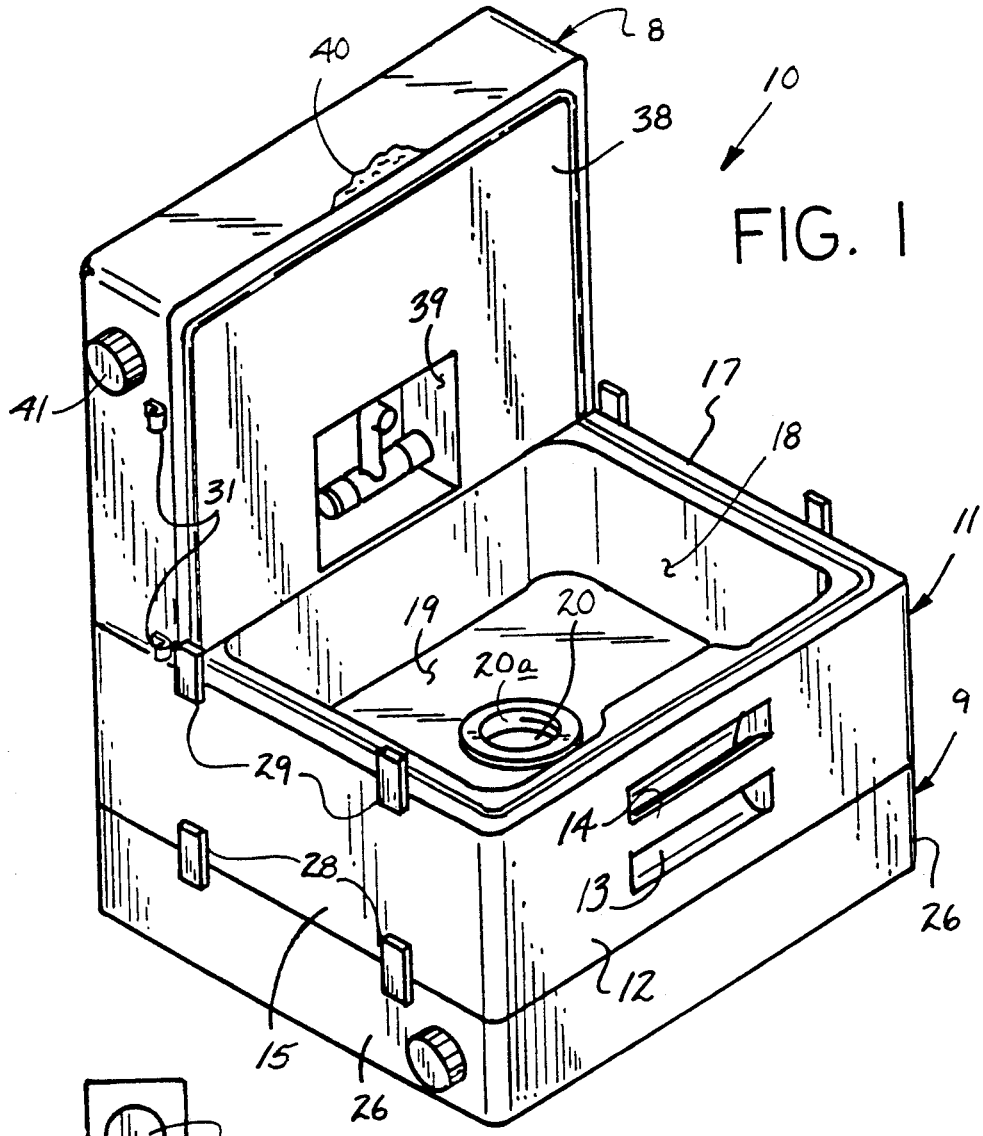
FIG. 1 is an isometric illustration of the invention in an operative configuration.
Figure 2:
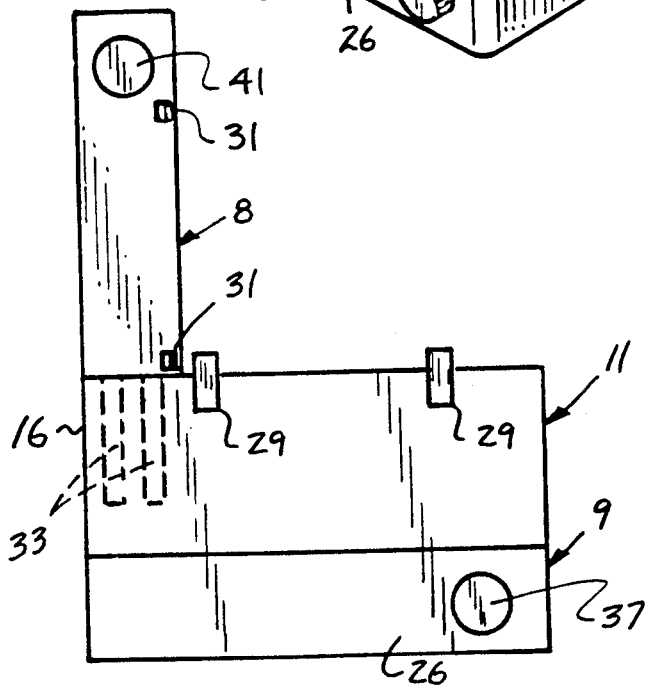
FIG. 2 is an orthographic side view of the invention, as indicated in FIG. 1.

With reference now to the drawings, and in particular to FIGS. 1 to 7 thereof, a new and improved portable sink apparatus embodying the principles and concepts of the present invention and generally designated by the reference numeral 10 will be described.

Figure 3:
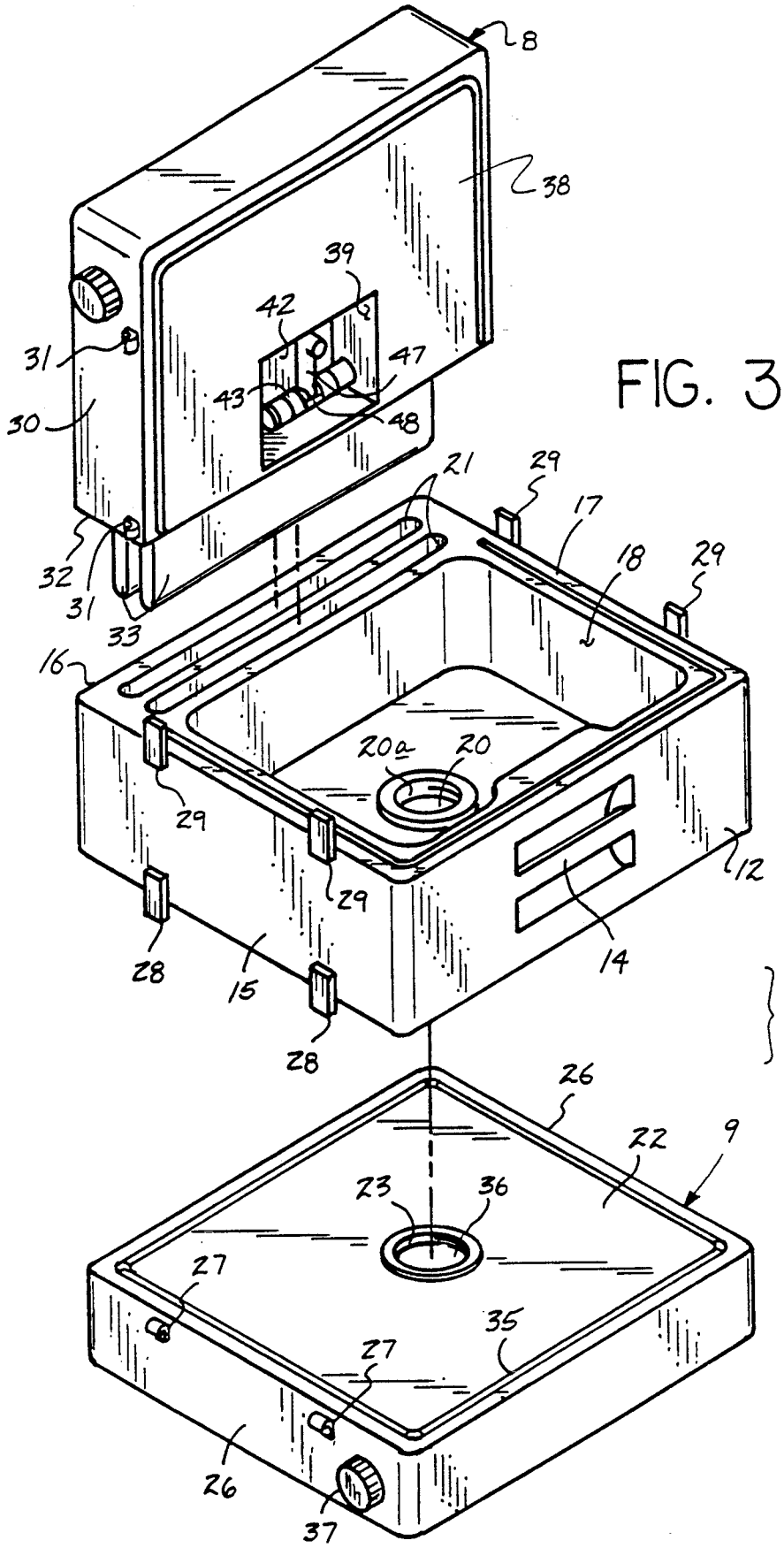
FIG. 3 is an isometric illustration of the invention indicating separation of the various modular components of the invention.
Figure 5:
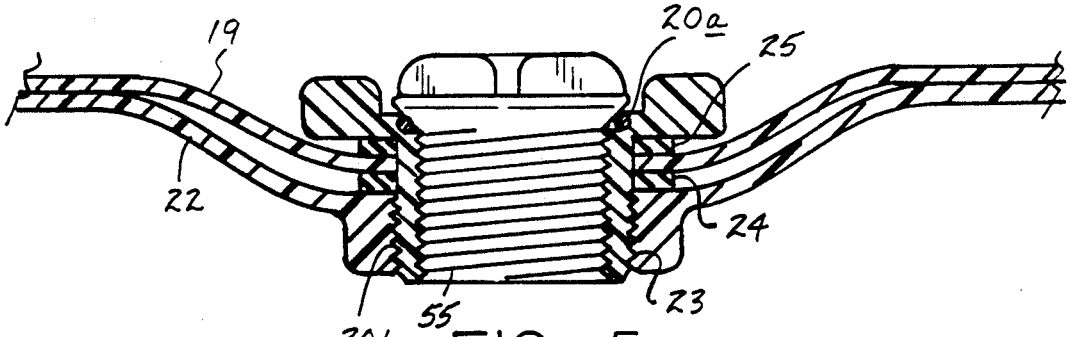
FIG. 5 is an orthographic cross-sectional illustration of the drainage cooperation between the central housing and the lower housing.

More specifically, the portable sink apparatus 10 of the instant invention essentially comprises a central housing 11 oriented intermediate a lower housing 9 and an upper housing 8. The central housing 11 includes a central housing front wall 12 with a front wall cavity 13 directed into the central housing front wall, with a front wall handle bar 14 extending over the front wall cavity 13 providing for a recessed and readily manipulatable handle structure for transport of the organization. Central housing side walls 15 are provided in a spaced relationship, with a central housing rear wall 16 spaced from the front wall. The central housing further includes a central housing top wall 17, with a sink cavity 18 directed into the top wall, with the top wall 17 positioned in surrounding relationship about the sink cavity 18, as indicated. The sink cavity 18 further includes a sink cavity floor 19 having a floor opening 20, to include an internally threaded cylindrical shell 28 directed into the floor opening 20, in a manner as indicated in FIG. 5. First and second annular sealing rings 24 and 25 are provided on opposed sides of the sink cavity floor 19. A first sealing ring 24 is interposed between the sink cavity floor 19 and a lower housing top wall 22, with the lower housing top wall 22 including a lower housing internally threaded opening 23 to threadedly receive and engage an externally threaded outer shell portion 20*b* of the shell 20*a*. An externally threaded plug member 55 is arranged for projection into the internally threaded shell 20*a* for use in stopping fluid flow from the central housing to the lower housing. It should be noted accordingly that the shell 20*a* permits the securement in a fluid-tight relationship of the sink cavity floor 19 to the lower housing top wall 22. Additionally, lower housing side walls 26 include lower housing side wall latch portions 27 cooperative with central housing side wall first latch portions 28. Central housing second latch portions 29 are arranged for securement to upper housing side wall latch portions 31 of the upper housing side walls 30. An upper housing rear wall 32 is provided, wherein spaced ribs 33 are orthogonally and integrally mounted relative to the upper housing rear wall 32 for reception within top wall parallel channels 21 of the central housing 11 to permit the orthogonal relationship of the central housing relative to the upper housing, in a manner as indicated in FIGS. 1 and 3 for example. Further, the lower housing includes a lower housing top wall periphery arranged in surrounding relationship about the lower housing top wall 22, with the periphery 34 including a continuous resilient sealing ring 35 to further prevent fluid flow between the central housing and the lower housing. A lower housing cavity 36 within the lower housing is drained by a lower housing drain cap 37 removably mounted relative to the lower housing side wall for permitting selective drainage of the lower housing cavity 36 subsequent to use.

Figure 4:
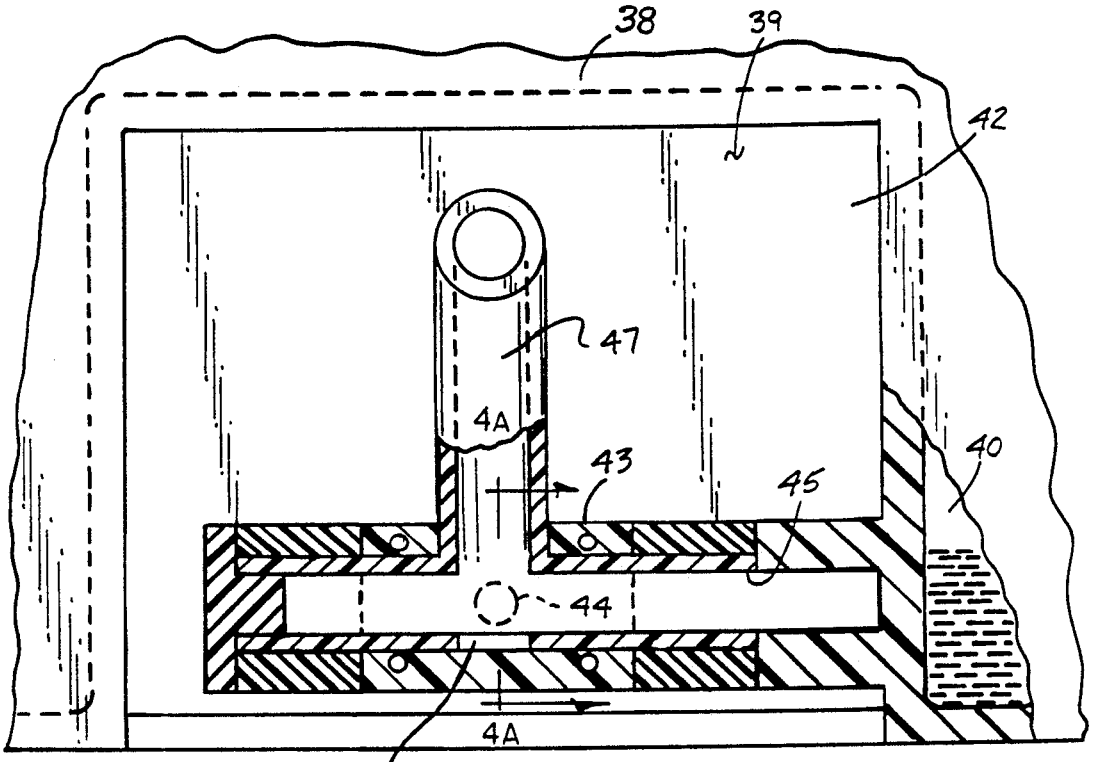
FIG. 4 is an enlarged orthographic view, partially in section, of the faucet construction of the invention.
Figure 4A:
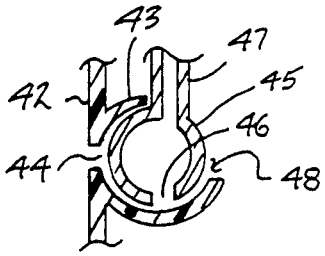
FIG. 4*a* is an orthographic view, taken along the lines 4*a*—4*a* of FIG. 4 in the direction indicated by the arrows.

The upper housing having upper housing floor 38 further includes an upper housing floor cavity 39, including a reservoir cavity 40 in the upper housing in communication with the upper housing floor cavity to an outer sleeve 43, in a manner as indicated in FIG. 4*a*. The outer sleeve 43 is fixedly secured to the floor cavity top wall 42 of the upper housing floor cavity 39. Water is directed into the upper housing reservoir cavity 40 through an upper housing reservoir cavity fill cap 41. An inner sleeve 45 is rotatably mounted within the outer sleeve, wherein the inner sleeve 45 is indicated in FIG. 4, wherein for purposes of illustration is illustrated in a spaced relationship where it is understood that the outer sleeve and inner sleeve are arranged in a contiguous sliding sealing relationship to prevent unwarranted and undesirable fluid flow therebetween. The inner sleeve 45 includes an inner sleeve opening 46 arranged for displacement relative to the outer sleeve opening 44 in a first position of the inner sleeve, wherein the inner sleeve and its associated conduit tube 47 is oriented in a substantially parallel relationship relative to the floor cavity top wall 42, wherein the conduit tube 47 orthogonally oriented relative to the floor cavity top wall 42 is arranged such that the inner sleeve opening 46 is aligned with the outer sleeve opening 44 to direct fluid flow between the outer sleeve and inner sleeve and through the inner sleeve conduit tube 47 that is pivotally mounted within an outer sleeve slot 48 in the outer sleeve to maintain alignment of the inner sleeve relative to the outer sleeve.

Figure 6:
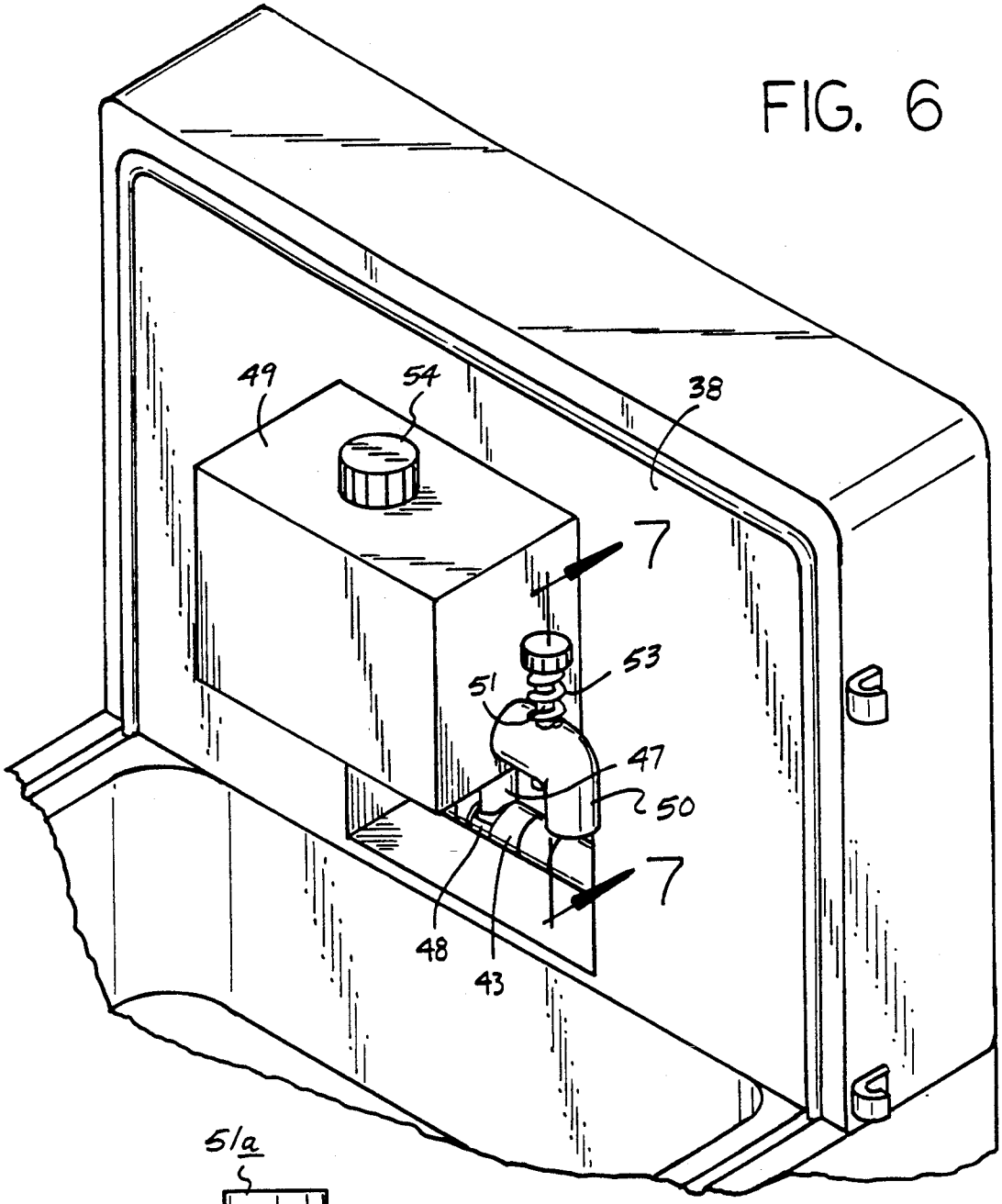
FIG. 6 is an isometric illustration of the invention utilizing a liquid soap dispenser.
Figure 7:
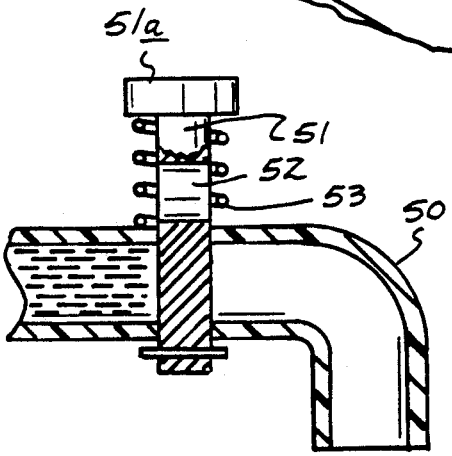
FIG. 7 is an orthographic view, taken along the lines 7—7 of FIG. 6 in the direction indicated by the arrows.

The FIGS. 6 and 7 indicate the use of a fluid soap reservoir housing 49 optionally employed by the invention fixedly mounted to the upper housing floor 38 above the upper housing floor cavity 39, wherein the fluid soap reservoir housing 49 includes a reservoir housing conduit 50 in fluid communication therewith, having a valve rod 51 directed through the reservoir housing conduit 50. The valve rod 51 includes a valve rod opening 52 that is displaced exteriorly of the reservoir housing conduit 50 in a projected orientation relative to the reservoir housing conduit 50, as illustrated in FIG. 7. The valve rod opening 52 is directed within the reservoir housing conduit 50 to permit fluid flow through the valve rod opening 52 and the associated reservoir housing conduit 50 in a selected manner. A spring 53 interposed between the reservoir housing conduit 50 and a valve rod head portion normally biases the valve rod opening 52 in a displaced orientation from within the reservoir housing conduit 50. The reservoir housing 49 further includes a reservoir housing fill cap 54 permitting selective replenishment of the fluid soap within that reservoir housing in use. Accordingly, when the upper housing is secured to the central housing when the central housing second latch portions 29 are secured to the upper housing latch portions 31, the fluid soap reservoir housing 49 is oriented within the sink cavity 18 for compact construction of the invention for transport and storage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable sink apparatus, comprising, a lower housing, a central housing, and an upper housing, the central housing having a central housing front wall, a central housing rear wall, central housing side walls, a central housing top wall, and a central housing floor, the central housing including a sink cavity directed through the central housing top wall to the central housing floor, with the sink cavity having a floor opening directed through the central housing floor within the sink cavity, and the lower housing having lower housing side walls, and a lower housing top wall, with the lower housing top wall including a lower housing top wall opening oriented to be in fluid communication with the floor opening when the central housing is positioned on the lower housing, and the central housing top wall including a plurality of channels orthogonally directed into the central housing top wall, with the upper housing defining a reservoir cavity including an upper housing floor, upper housing spaced side walls, and an upper housing rear wall, with the upper housing rear wall including a plurality of ribs orthogonally and fixedly mounted to the upper housing rear wall, wherein the ribs are arranged for complementary reception, respectively, within the channels, the upper housing further including means for selectively communicating the reservoir cavity with the sink cavity, whereby the apparatus may be used as a sink when the ribs are engaged with the channels and may be easily transported when the upper housing is positioned on the central housing with the upper housing is positioned on the central housing with the upper housing floor engaging the central housing top wall.

2. An apparatus as set forth in claim 1 wherein the central housing includes first latch members mounted to each of the central housing side walls, and second latch members mounted to each of the central housing side walls, wherein the upper housing includes upper housing latch members arranged for securement to the central housing second latch members when the upper housing floor is positioned to engage the central housing top wall, and wherein the lower housing includes lower housing latch members secured to the lower housing side walls, wherein the lower housing latch members are arranged for securement to the central housing first latch members when the central housing is positioned on the lower housing.

3. An apparatus as set forth in claim 2 wherein the lower housing top wall opening includes an internally threaded surface, and an internally threaded cylindrical shell having an externally threaded shell portion arranged for reception within the lower housing top wall opening, and a first annular seal oriented between the central housing and the lower housing top wall in surrounding relationship relative to the shell, and wherein a second annular seal is oriented between the shell and the central housing floor, and an externally threaded plug arranged for reception within the internally threaded cylindrical shell.

4. An apparatus as set forth in claim 3 wherein the upper housing includes an upper housing floor cavity directed into the upper housing floor, the communicating means being positioned in the upper housing floor cavity and including an outer sleeve fixedly mounted to the upper housing floor cavity, with the outer sleeve having an outer sleeve opening in fluid communication with the upper housing reservoir cavity, and the outer sleeve including an inner sleeve rotatably mounted within the outer sleeve, and the inner sleeve including an inner sleeve opening arranged for selective alignment with the outer sleeve opening, with the inner sleeve including an inner sleeve conduit, the outer sleeve including an outer sleeve slot, and the inner sleeve conduit arranged for pivoting within the outer sleeve slot permitting selective alignment of the outer sleeve opening with the inner sleeve opening.

5. An apparatus as set forth in claim 4 wherein the lower housing includes a lower housing cavity and lower housing drain cap removably mounted relative to the lower housing cavity, and the upper housing includes an upper housing fill cap mounted to the upper housing permitting selective replenishment of the upper housing reservoir cavity upon removal of the upper housing fill cap relative to the upper housing.

6. An apparatus as set forth in claim 5 wherein the lower housing top wall includes a lower housing top wall periphery, and the lower housing top wall periphery includes a continuous resilient sealing rib arranged for engagement with the central housing floor.

7. An apparatus as set forth in claim 6 including a fluid soap reservoir housing fixedly mounted to the upper housing floor spaced from the upper housing floor cavity, wherein the fluid soap reservoir housing includes a reservoir housing conduit in fluid communication with the fluid soap reservoir housing, and the reservoir housing conduit including a valve rod reciprocatably directed through the reservoir housing conduit, the valve rod including a valve rod opening and a valve rod head portion, and a spring interposed between the valve rod head portion and the reservoir housing conduit, with the valve rod including a valve rod opening arranged for projection into the reservoir housing conduit permitting fluid flow through the reservoir housing conduit.

* * * * *